US005083520A

United States Patent [19]

Bonnet

[11] Patent Number: 5,083,520

[45] Date of Patent: Jan. 28, 1992

[54] MAST, IN PARTICULAR FOR SAILING BOAT

[76] Inventor: Claude Bonnet, 42 Rue des Vals, 42160 Andrezieux Boutheon, France

[21] Appl. No.: 477,845

[22] PCT Filed: Jun. 9, 1989

[86] PCT No.: PCT/FR89/00293

§ 371 Date: Mar. 6, 1990

§ 102(e) Date: Mar. 6, 1990

[87] PCT Pub. No.: WO89/11996

PCT Pub. Date: Dec. 14, 1989

[30] Foreign Application Priority Data

Jun. 9, 1988 [FR] France ..... 88 08100

[51] Int. Cl.[5] ..... B63B 15/00

[52] U.S. Cl. ..... 714/91; 114/102; 114/39.1

[58] Field of Search ..... 114/39.1, 89-91, 114/102-107, 111

[56] References Cited

U.S. PATENT DOCUMENTS

| | | | |
|---|---|---|---|
| 1,408,868 | 3/1922 | Dutcher | 114/90 |
| 2,147,501 | 2/1939 | Ryder | 114/102 |
| 3,802,371 | 4/1974 | Jastrab | 114/102 |
| 4,047,493 | 9/1977 | Menegus | 114/39.1 |
| 4,064,821 | 12/1977 | Roberts, Jr. et al. | 114/39.1 |
| 4,603,648 | 8/1986 | Berge | 114/39.1 |
| 4,856,449 | 8/1989 | Walker | 114/103 |

FOREIGN PATENT DOCUMENTS

| | | | |
|---|---|---|---|
| 46007 | 2/1936 | France | 114/90 |
| 8600661 | 10/1987 | Netherlands | 114/91 |
| 1153915 | 6/1969 | United Kingdom | 114/90 |

OTHER PUBLICATIONS

French Patent Office Search Report, 24, Mar., 1989.

*Primary Examiner*—Ed Swinehart

*Attorney, Agent, or Firm*—Eckert, Seamans, Cherin & Mellott

[57] ABSTRACT

A mast for a sailboat includes at least two mast components having a lower end attached to the boat on opposite sides of a longitudinal median plane of the boat. Upper ends of the mast components are connected to each other. Each of the mast components has an aerodynamically profiled cross-section and is angularly movable around its longitudinal axis as a function of wind direction in order to obtain the best aerodynamic or aerologic output of a sail set and rigging assembly. The mast components are coupled to a system which provides independent angular slewing of the mast components with respect to one another and the wind. The system includes a coupling bar which is hingedly attached via connecting rods to the mast components. The coupling bar is mounted on the deck of the boat and is capable of guided translational movement when fitted with control means.

10 Claims, 6 Drawing Sheets

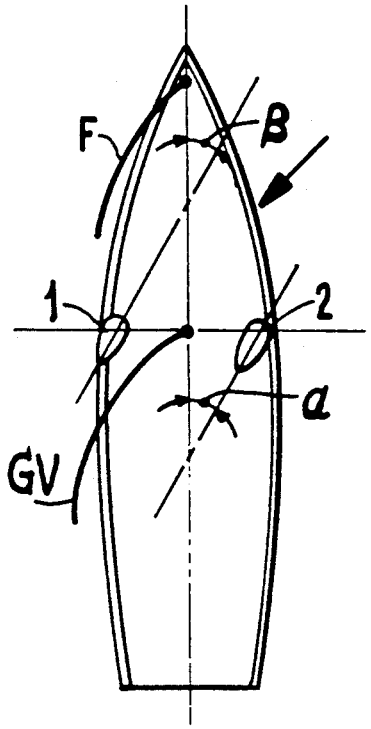
Fig. 7.
Fig. 8.
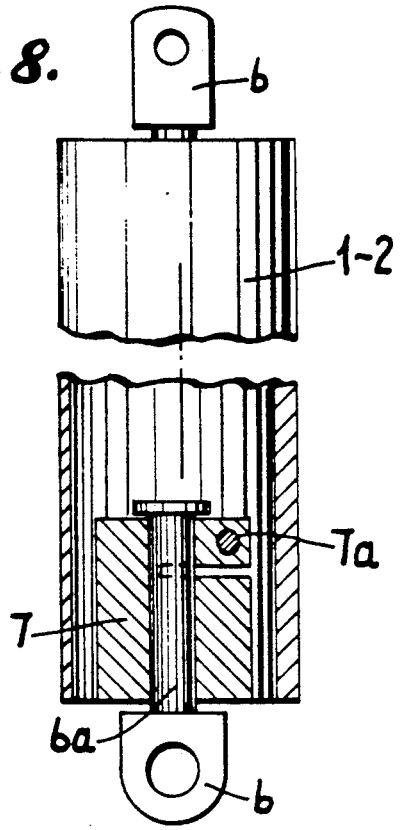
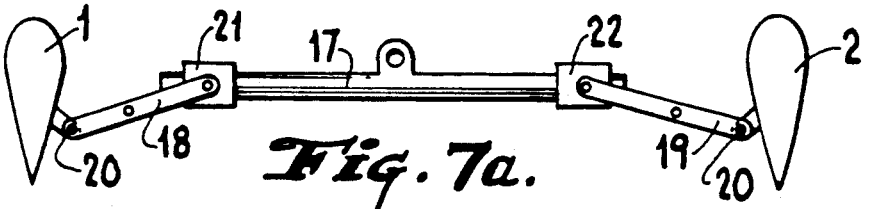
Fig. 7a.
Fig. 7b.
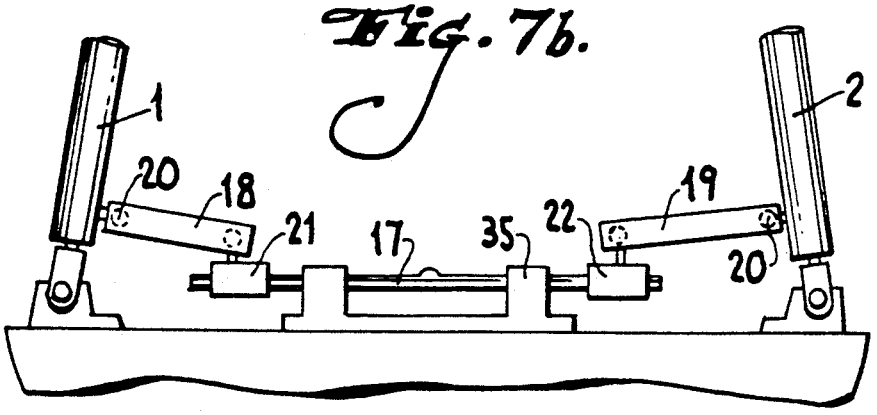

MAST, IN PARTICULAR FOR SAILING BOAT

BACKGROUND OF THE INVENTION

The invention relates to the technical sector of rigging of sailing boats. Sailing boats, regardless of their design, have one or several masts, fixed substantially at the level of the median longitudinal centre line of the hull, every mast being made up of a unique component. These masts have tacks of the sails set positioned on the deck, so that each mast is directly stressed by the bending forces which the sails set applies due to its connection with the hounding. Therefore, it is often necessary to call for guy ropes, pole bars, runners and tackle and the suchlike.

In addition, problems arise relating to wear and risks of breaking and tearing the sails, resulting from the friction of the sails directly against the mast and the other pieces of rigging.

In order to overcome these disadvantages and solve the problem brought up of having total freedom of the positioning of the tacks of the sail set on the deck, the production of a mast is proposed, comprised of at least two independent components likely to be fixed at one end, either side of the median longitudinal plane of the boat and connected at the other end, either in a close-joining manner or not.

This state of the art can be illustrated non-limitatively in the U.S. Pat. No. 2,147,501 and the NL Patent 86.00661 for example.

Using this special design of the mast in two independent components, it was desired to improve the aerolic output of the sail set and rigging assembly and facilitate the balancing of the surfaces of sail set of mainsails and head sails in particular.

SUMMARY OF THE INVENTION

According to the invention, this problem is overcome in that every component has an aerodynamic profiled cross-section thereby being fixed at the base and coupled at the top part whilst being able to angularly slew along a longitudinal axis in function of the direction of the wind in order to obtain the best aerolic output of the sail set and rigging assembly.

The components cooperate with means for locking in an angular position. In an advantageous manner, the components cooperate, especially at the base, with means likely to provide the simultaneous or independent angular slewing of the said components at will.

In order to solve the problem brought up relating to the angular mounting along the longitudinal axis of each of the components, the latter are mounted so as to freely rotate on an angularly fixed bush, with the capacity of adjustment, on a support component designed so as to be coupled on part of the boat, the deck in particular.

The support component has a cross section profile determined in order to enable, in combination with the elasticity of the material of which it is made, small angular variations from the front to the rear of the components with respect to the deck.

Another problem the invention intends to solve is to be able to control and slew each component of the mast in function of the wind by taking into account the possible deviation of airstreams created by the sails to ensure better adjustment of the component weather side and lee side.

This problem is overcome in that each of the components are coupled to a system likely to simultaneously control the said components according to different angular slewing to enable in particular, slewing adjustment of the said components with respect to one another and the wind.

The system includes a coupling bar connected by a system of connecting rods hinged to each of the components, the said bar being mounted so as to move in guided translation on the deck by being fitted with control means.

Another problem the invention intends to solve is to increase the rigidity of the mast as defined. With this in mind, the components are connected by one or several braces mounted so as to hinge around the said components, the said braces being profiled so as to clear the free space formed between the two components in order to leave the passage for a sail hounding.

The brace(s) are designed so as to enable additional standing or running rigging to be fitted.

According to another characteristic, in order to solve the problem of having both good fixing at the front independent from the separation from the base of the components and balancing of the forces applied during the different manoeuvres, without this creating parasite loads or torques on the masthead or its pivoting movement, the components are connected at the top by a projecting vertical plate, formed and designed to enable standing and/or running rigging to be fixed thereby offsetting them laterally to the front and/or the rear and/or vertically with respect to the masthead, the said plate being mounted so as to oscillate in its plane, from the front to the rear.

The built-up components are mounted at the end of the components and are capable of rotating.

The sides of the plate are fitted with halyard return blocks and running rigging to guide them and provide the return towards the deck, along the components, outside or inside them.

The head of each component is coupled either directly or by means of built-up components to a means of the ball and socket type acting as a support for the plate.

Another problem the invention intends to solve is to design a mast from two components, in the conditions indicated, which are lightweight and very rigid, particularly when the buckling strength is concerned.

With this in mind, every component comprises a main solid profiled part, designed so as to take, vertically, throughout or along part of its length, profiled cheeks limiting an internal space likely to take a stiffener, a vertical reinforcement plate being mounted on part of the main part, inside the space limited by the said cheeks.

The invention is now described in more detail with the help of the accompanying drawings in which:

BRIEF DESCRIPTION OF THE DRAWINGS

FIG. 7 is a purely schematic plan view showing the angular slewing of each component of the mast taking the wind direction and deviation of airstreams created by the sails, into consideration.

FIG. 7*a* is a plan view showing an embodiment of the coupling system between the components of the mast, likely to provide them with an angular variation with respect to the longitudinal axis which is different with respect to one another.

FIG. 7*b* is a front view corresponding to FIG. 7*a*.

FIG. 8 shows a section of another embodiment of the slewing system of the components of the mast.

In the embodiment illustrated, the mast described as a whole by (M), is made of up of least two components (1) and (2) likely to be fixed at one of the ends, either side of the median longitudinal axis of the boat, in a symmetrical way in particular. The opposite part of the fixing part of the components (1) and (2) on the boat, are coupled either in a close-joining manner or not.

DESCRIPTION OF THE PREFERRED EMBODIMENT

According to an important characteristic of the invention, both of the components (1) and (2) making up the mast, have an aerodynamic profiled shape and, pivot, along a longitudinal axis so as to be slewed in function of the direction of the wind to obtain the best aerolic output of the sail set and rigging assembly. The pivoting movements of both components may be independent from one another or coordinated between one another and cooperate with position locking means. In order for the pivoting to be provided, a mechanical or another system is fitted to the head and foot of the components to provide both the fixings required of the head and foot of the mast by allowing the components to angularly slew.

Figure 6:
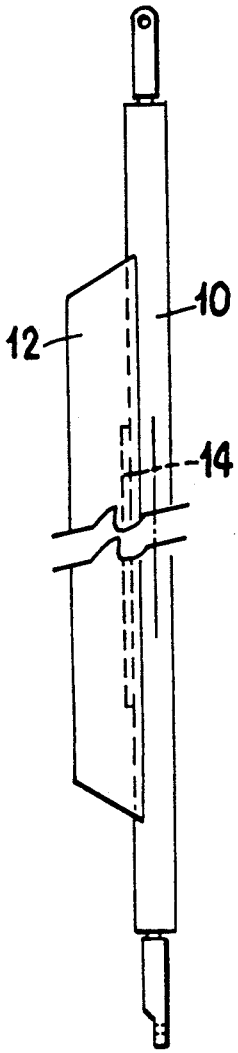
FIG. 6 is a front view of one of the components of the mast according to the embodiment in FIG. 5.
Figure 5:
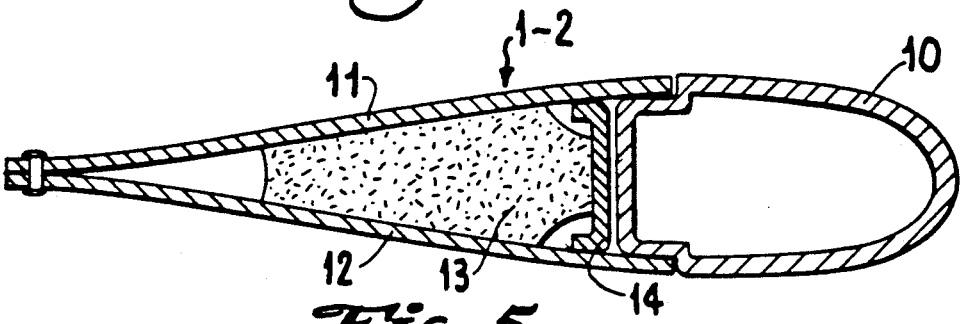
FIG. 5 is a cross section showing the make up of each component of the mast.
Figure 9:
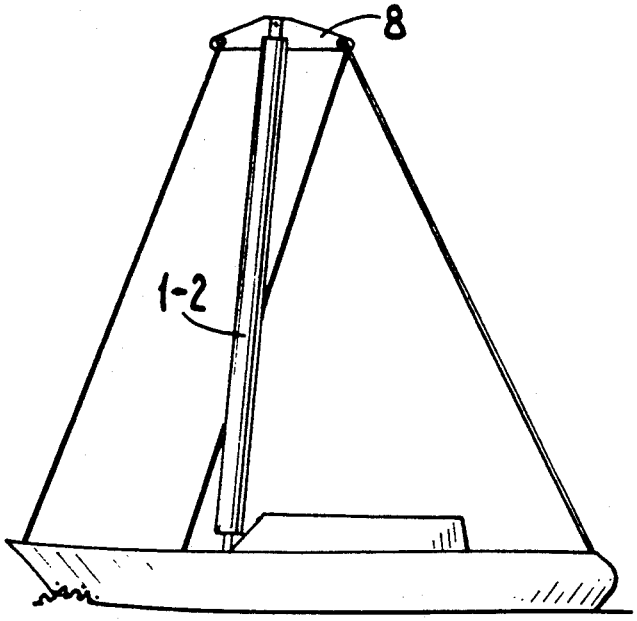
FIG. 9 shows an example of fixing standing and/or running rigging at the masthead.
Figure 10:
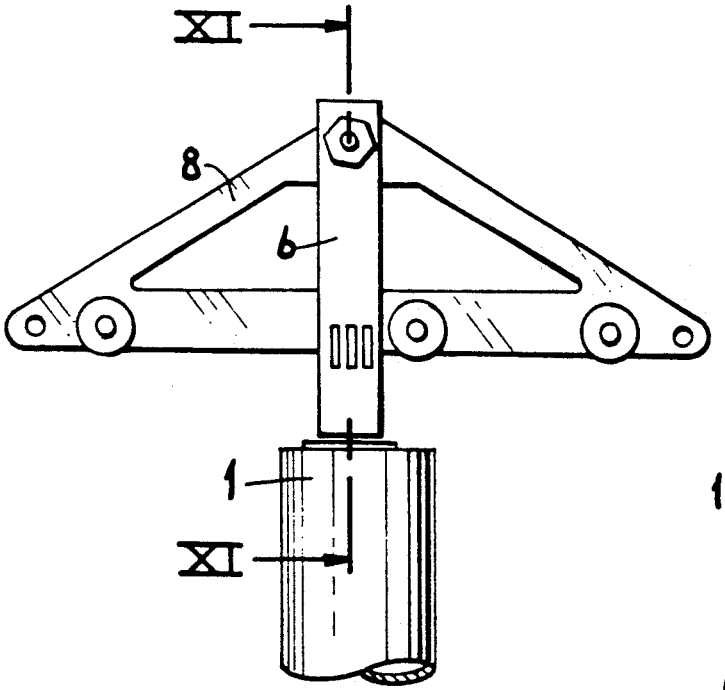
FIG. 10 is a partial view showing the hinged and slewing assembly of the fixing plate at the masthead.
Figure 11:
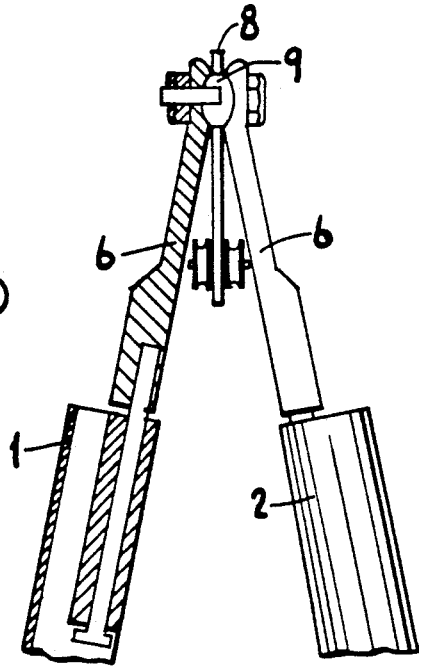
FIG. 11 is a cross section considered along line 11—11 of FIG. 10.

As shown in FIGS. 5 and 6, both components (1) and (2) are comprised of a main solid part (10) the cross section of which is formed so as to correspond to a fraction of the aerodynamic profile. This part (10) is designed so as to take, in a vertical manner, throughout or along part of its height, profiled cheeks (11) and (12) limiting out an internal space. This space can be filled totally or partially by stiffeners of the cheeks (11) and (12) made up, for example, of lightweight materials (13) or side members. In addition, with a view to reducing the weight, particularly of the main part (10) and increasing its buckling strength, the rear part of the said part (10) may take, either throughout or along part of its height and between the cheeks (11) and (12), stiffening plates or sections (14).

In an advantageous manner, the assembly made up of the cheeks (11) and (12) and the stiffeners (13) is integral to the part (10) taking the stiffener (14), capable of being dismantled in order to temporarily suppress the directional effect in the event of prolonged stopping for example. Similarly, each assembly (11-12-13) is anticipated being of several independent sections arranged on top of one another in order to vary the bearing surface.

Figure 14:
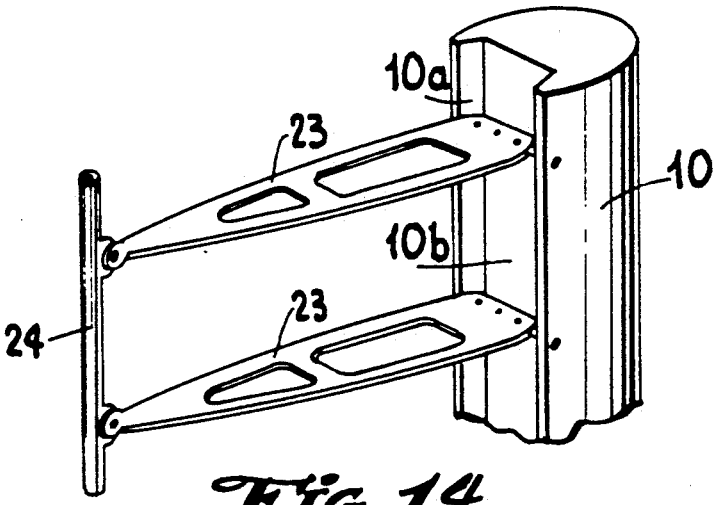
FIG. 14 is a partial view in perspective, of another embodiment of the mast.
Figure 15:
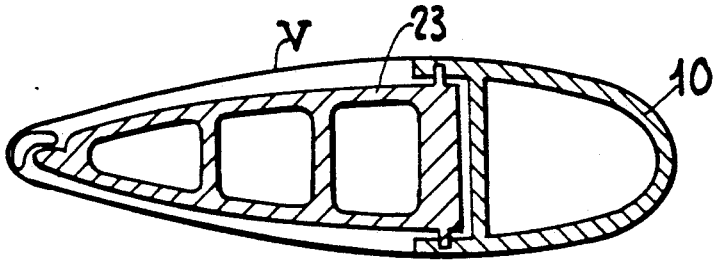
FIGS. 15 and 16 are two plan sections of the mast according to FIG. 14, showing two alternative models of assembly of a sail.
Figure 16:
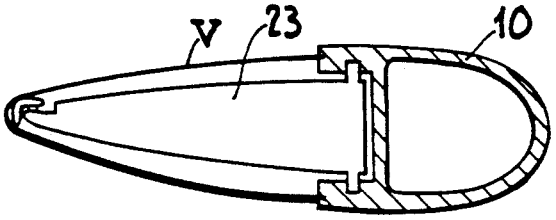

In another embodiment illustrated in FIGS. 14 to 16, the solid main part (10) of the mast, takes so as to be freely hinged, especially between two wings (10*a* and 10*b*), a series of spaced spacers (23) which are profiled, which from a plan view, gradually decrease taking the aerodynamic effect desired into account. At the other end, every spacer is hinged to a vertical component (24) which acts as a trailing edge bar. Given these conditions, a sail (V) can be mounted in combination with the spacers (23) and part (10), so as to create a tubular sail.

In FIG. 15, the sail (V) is engaged both around the part (10) and spacers bars (23), whereas in FIG. 16, the sail is only arranged around spacers (23), the free ends of the said sail being engaged, so as to slide and be retained in profiled grooves formed at the bottom of the wings (10*a*) and (10*b*) of part (10). The movement of the spacers, considering they are hinge mounted, enables the sail to be tensioned after it is fitted and reduces the surface by lifting it accordingly.

Figure 17:
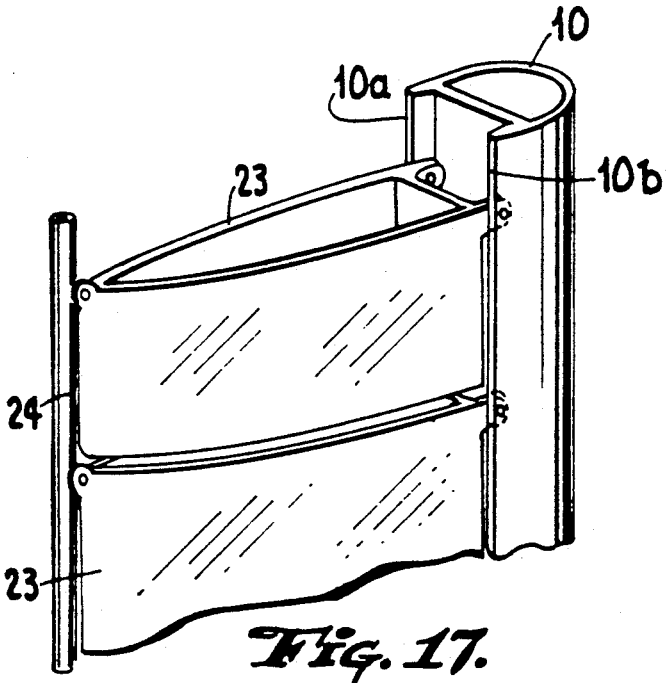
FIG. 17 is a partial view, in perspective of another embodiment of the mast.

In the embodiment in FIG. 17, part (10) takes, whilst freely hinging, a plurality of components (25) arranged on top of one another thereby being likely to occupy a perpendicular or substantially perpendicular position to the said part (10) or an angular position with respect to the said part (10) in order to reduce the bearing surface.

Figure 18:
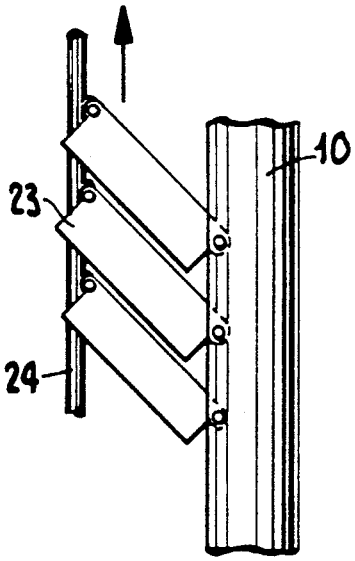
FIG. 18 is a schematic front view, corresponding to FIG. 17, showing the mast with certain component parts in an angular position.

With this in mind, every component (25) comprises two profiled cheeks (25*a*) and (25*b*) hinged at the top between the two wings (10*a*) and (10*b*) of part (10) so as to capable of being angularly positioned against the said part (10). These two cheeks are connected at the other end so as to be hinged, at the top, to a vertical component (26) so that by pulling the component (26) upwards, the angular positioning of the assembly of components (25) which tend to be applied against the part (10), (FIG. 18), is provoked simultaneously.

FIG. 8 shows and example of a system allowing both the fixing and autoangular slewing of components (1) and (2). In order to do this, the fixing and coupling component (6) relating to the base of each of the components (1) and (2) and the top part of the latter, has a bolt (6*a*) mounted so as to freely rotate in a bushing used as a bearing (7) and integral to the corresponding component. In addition, the bushing (7) is provided with a means (7*a*) to prevent the bolt (6*a*) from rotating at will.

Figure 1:
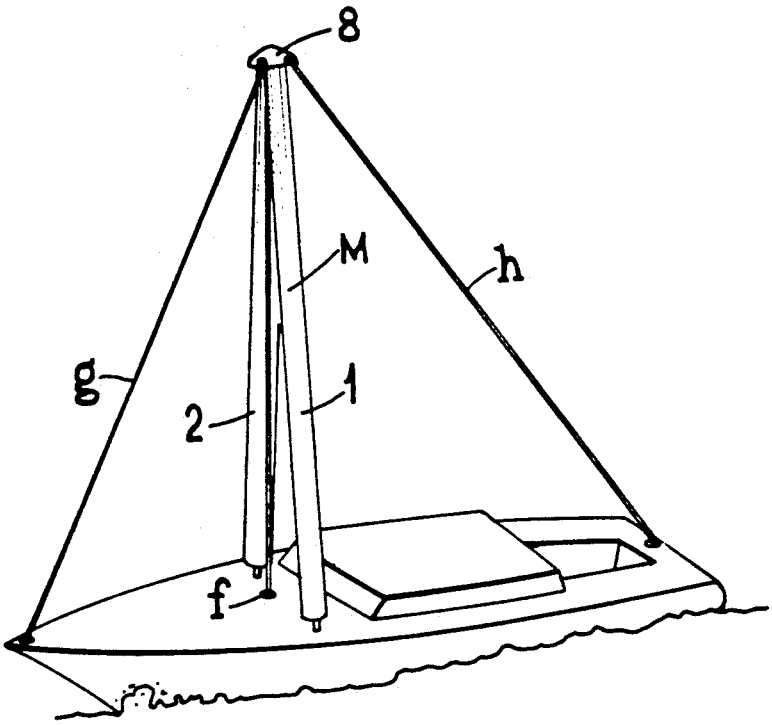
FIG. 1 is a perspective view of a sailing boat fitted with the mast according to the invention.
Figure 2:
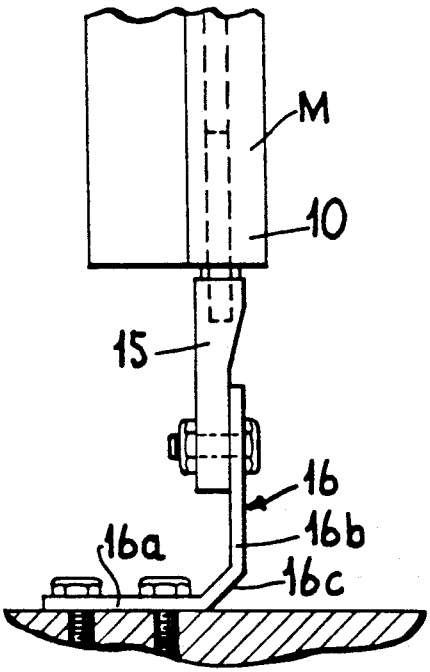
FIG. 2 is a partial side view showing the assembly of the base of the components of the mast on the deck of the boat, capable of angularly slewing along the longitudinal axis.
Figure 3:
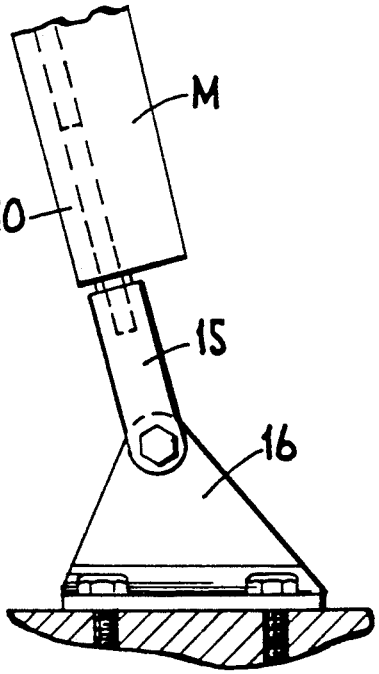
FIG. 3 is a side view corresponding to FIG. 2.

FIGS. 2 and 3 show a preferred embodiment of the fixing and auto-angular slewing of the base of components (1) and (2) with respect to the deck in particular. With this in mind, the base of components (1) and (2), particularly the main part (10), is mounted so as to freely rotate on a bushing (15) fixed onto a support component (16) capable of being adjusted and locked in an angular position. The support (16) is designed so as to be fixed to part of the deck in particular by any known, suitable means.

The support component (16) has a cross section with a profile determined to enable, in combination with the elasticity of the material of which it is made, small angular variations from the front to the rear. For example, this component (16) is made up of a support base (16*a*) extended by a vertical wing (16*b*) taking the fixing bushing (15), in the conditions indicated. The base (16*a*) and wing (16*b*) are connected by an angular folding line (16*c*) facilitating the elastic deformation of the said support, without permanent set.

According to another important characteristic of the invention, the components (1) and (2) are servocontrolled by a coupling system enabling them to angularly slew with respect to the longitudinal axis of the boat in a different manner for every component, taking the direction of the wind and the deviation of airstreams by the sails (F) and (GV) into account, as schematically shown in FIG. 7.

As shown in FIGS. 7*a* and 7*b*, this coupling system mainly comprises of a connecting bar (17) linked by a system of connecting rods (18–19) hinged to both the components (1) and (2). This bar (17) is mounted so as to move in guided translation on the deck by being fixed to control means of any known and suitable type, such as cables in particular.

For example, every connecting rod (18–19) is coupled by ball and socket type means (20), firstly to the components (1) and (2) and secondly, to a carriage (21–22) mounted capable of sliding on a connecting bar (17). The bar (17) is mounted so as to slide by being guided, on a support component (35) fixed onto the deck.

Therefore, it appears that the transversal movement of the bar (17) in one direction or another, causes the components (1 and 2) to rotate according to two different angles ($\alpha$) and ($\beta$), (FIG. 7), due to the action of the connecting rods (18–19). Furthermore, when the coupling system is in a determined position, it is possible to modify the relative angular positioning of component (1) with respect to component (2) or vice-versa, by moving the corresponding slide (21 or 22) supporting the connecting rods.

As a result, the geometry of the coupling and relative positioning system of the slide on the connecting bar, provides many coupling possibilities of relative angular slewing of components (1) and (2), firstly with respect to the wind, and secondly, the said components with respect to one another. As schematically shown in FIG. 7, it is easy to obtain an angle ($\alpha$) greater than the angle ($\beta$) corresponding to better adjustment of the slewing of the components considered weather side and lee side.

Figure 4:
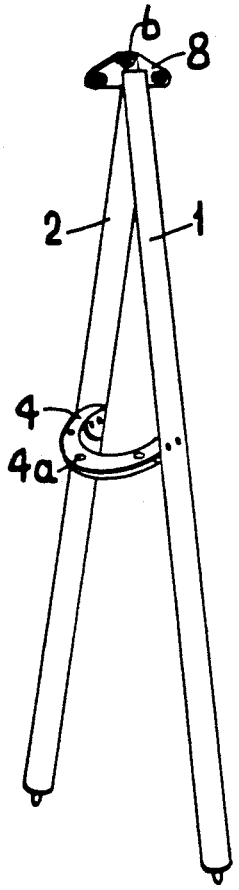
FIG. 4 shows a perspective view of a mast fitted with a brace.

The top part of components (1) and (2) may have one or several connections (4) which are intermediate, rigid or semi-rigid, acting as a brace. The brace(s) (4) are profiled, in the arc of a circle in particular, in order to free the space between the two components (1) and (2). This or these braces can be fixed in (4*a*) to enable standing or running rigging to be established (FIG. 4).

Figure 4A:
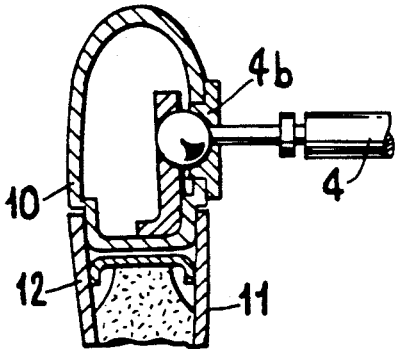
FIG. 4*a* is a partial sectional view showing a coupling embodiment hinged between the brace and the component parts of the mast.

Considering the angular slewing capacity of each of the components (1) and (2), the brace(s) (4) are mounted so as to be hinged with respect to the said components. For example, as shown in FIG. 4*a*, the coupling is made by a ball and socket system (4*b*).

It is also anticipated to provide at the level of the coupling of the top part of the components (1) and (2), a plate (8), substantially slewed in the median plane of the said two components (1) and (2). This plate (8) is designed so as to increase the distance between the end of the components (1) and (2) towards the front and/or rear and the fixing points (8*a*) of the standing and/or running rigging which are fitted in the said plate.

In a preferred manner, the plate (8) is mounted at the end of the components (1) and (2), capable of angular slewing thereby being likely to oscillate in its plane, from the front to the rear, so as to refrain from transferring any load or torque or twist to the masthead (1) (2). For example, a coupling component of the ball and socket type (9) can be used as a support for the plate (8).

In an advantageous manner, this ball and socket coupling system, can be combined with the angular slewing system of the components (1) and (2). The ball and socket is substantially in the plane formed by the position axes of the components (1) and (2).

As already indicated, this combined system, provides both good fixing at the head independent from the separation from the base of the components and balancing of the forces applied to the head fixing plate for the different manoeuvres which are connected to it without this creating undue loads or torques on the masthead or on its pivoting movement.

The sides of the plate (8) can be fitted with halyard return blocks and running rigging to guide them and provide the return towards the deck, along the components (1) and (2) and inside or outside them.

Figure 12:
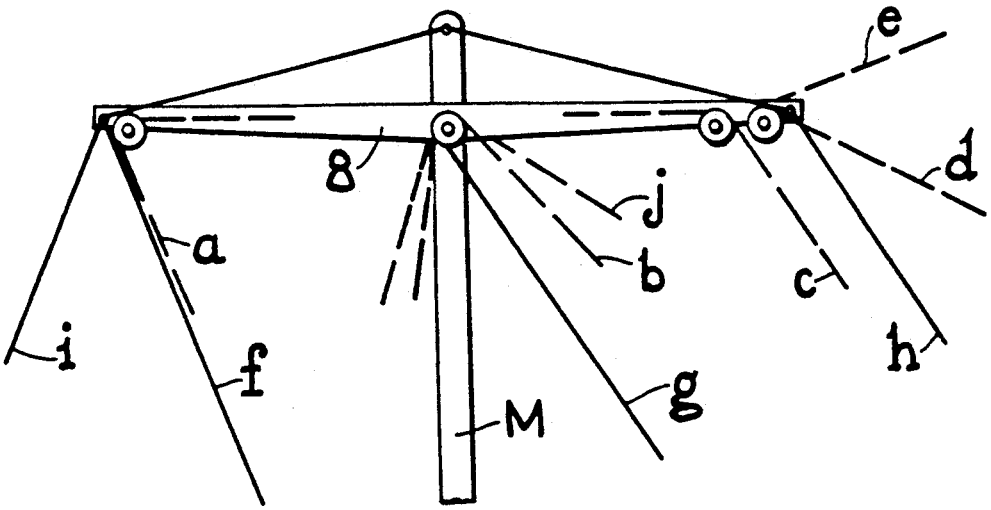
FIG. 12 is a purely schematic view showing an example of assembly of the different fixing points of the standing and/or running rigging of the sail set.
Figure 13:
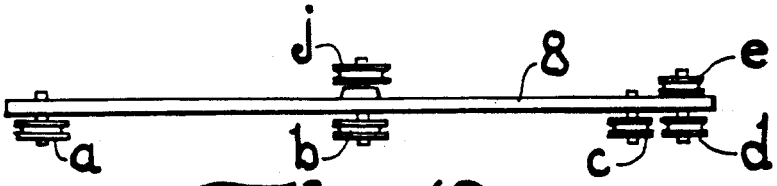
FIG. 13 is a plan view corresponding to FIG. 12.

For example, as schematically shown in FIGS. 12 and 13, the plate (8) can be designed to enable the assembly of halyards (a, b, c, d, e) of the mainsail, jib, genoa, spinnakers, the assembly of stays, (f, g, h) of the mainsail, jib, genoa, the assembly of the double preventer shroud (i) for example and the assembly of the downhaul boom.

The invention can be applied to any type of sailing boat with one or several masts such as the ketch, yawl, schooner or multihull, etc.

I claim:

1. A mast for a sailboat for supporting sail rigging, said mast comprising:

at least two components, each having a lower end attached to the sailboat on opposite sides of a longitudinal median plane of said sailboat, upper ends of the at least two components being coupled relative to each other, each of the at least two components comprising an integral main part which has a transverse cross-section corresponding to a fraction of an aerodynamic profile, and a pair of profiled cheeks attached to said integral main part and defining an internal space for receiving at least one stiffener, wherein the at least two components are angularly movable around their longitudinal axes for maximizing aerodynamic output from the sail rigging as a function of wind direction.

2. The mast according to claim 1, wherein the integral main part is rotatably mounted on a bushing, the bushing being attached to a support which is angularly movable and lockable in position, the support being attachable to a deck of the sailboat.

3. The mast according to claim 2, wherein the support has a cross-section which allows, in combination with elasticity of its constituent material, forward and backward angular variations of the integral main part in relation to the deck.

4. The mast according to claim 1, wherein the integral main parts are connected by at least one transverse brace which is pivotally attached to each of the integral main parts.

5. The mast according to claim 4, further comprising at least one transverse brace for installation of standing and running rigging.

6. The mast according to claim 1, wherein the upper ends are coupled by a projecting vertical plate defining means for attachment of standing and running rigging, the plate being mounted to oscillate forward and backward in its plane.

7. The mast according to claim 6, wherein the upper ends are attached to the projecting vertical plate by a ball and socket coupling.

8. The mast according to claim 6, further comprising return pulleys mounted to the projecting vertical plate for guiding halyards and running rigging along the at least two components.

9. The mast according to claim 1, further comprising a system of connecting rods hingedly attached to the at least two components and mounted for translational movement on the deck, the system of connecting rods being operable by control means associated therewith, for simultaneously moving the at least two components in different angular orientations.

10. A mast for a sailboat, said mast comprising:

at least two components having a lower end attachable to the sailboat on opposite sides of a longitudinal median plane of said sailboat, upper ends of the at least two components being coupled relative to each other, each of the at least two components having an aerodynamically profiled cross-section and being angularly movable around its longitudinal axis as a function of wind direction in order to obtain the best aerodynamic output for a sail set and rigging assembly, wherein the at least two components are coupled to a system which provides independent angular slewing of said at least two components with respect to one another and the wind direction, the system comprising a coupling bar hingedly attached via connecting rods to the at least two components, the coupling bar being mounted on the deck of the boat and capable of guided translational movement when fitted with control means.

* * * * *